US007694715B2

(12) United States Patent
Czerwinski et al.

(10) Patent No.: US 7,694,715 B2
(45) Date of Patent: Apr. 13, 2010

(54) METAL MOLDING SYSTEM

(75) Inventors: Frank Czerwinski, Bolton (CA); Robert Domodossola, Brampton (CA); Giuseppe Edwardo Mariconda, Newmarket (CA); Derek Kent William Smith, Richmond Hill (CA)

(73) Assignee: Husky Injection Molding Systems Ltd., Bolton, ON. (CA)

( * ) Notice: Subject to any disclaimer, the term of this patent is extended or adjusted under 35 U.S.C. 154(b) by 565 days.

(21) Appl. No.: 11/625,996

(22) Filed: Jan. 23, 2007

(65) Prior Publication Data

US 2008/0176094 A1 Jul. 24, 2008

(51) Int. Cl.
*B22D 17/00* (2006.01)

(52) U.S. Cl. ..... 164/312; 164/113; 164/900

(58) Field of Classification Search ..... 164/113, 164/312, 900

See application file for complete search history.

(56) References Cited

U.S. PATENT DOCUMENTS

| | | | | |
|---|---|---|---|---|
| 4,694,881 | A | 9/1987 | Busk | |
| 5,685,357 | A * | 11/1997 | Kato et al. | 164/113 |
| 5,765,623 | A | 6/1998 | Bell et al. | |
| 5,983,976 | A | 11/1999 | Kono | |
| 5,983,978 | A * | 11/1999 | Vining et al. | 164/312 |
| 6,241,001 | B1 | 6/2001 | Kono | |
| 6,742,570 | B2 * | 6/2004 | Kono | 164/312 |
| 6,745,818 | B1 * | 6/2004 | Fan et al. | 164/113 |
| 6,789,603 | B2 | 9/2004 | Kono | |
| 6,860,316 | B2 * | 3/2005 | Wu et al. | 164/312 |
| 7,066,236 | B2 | 6/2006 | Fujikawa | |
| 2005/0103461 | A1 | 5/2005 | Jorstad et al. | |

FOREIGN PATENT DOCUMENTS

EP 01442810 B1 7/2005

OTHER PUBLICATIONS

Frank Czerwinski, The Generation of Mg-Al-Zn Alloys by Semisolid State Mixing of a Particulate Precursors, Acta Materialia 52, 2004, pp. 5057-5069, Elsevier B.V.

Frank Czerwinski, A Novel Method of Alloy Creation by Mixing Thixotropic Slurries, Material Science and Engineering A 404, 2005, pp. 19-25, Elsevier B.V.

Frank Czerwinski, The Concept and Technology of Alloy Formation During Semisolid Injection Molding, SAE Technical Paper Series, 2005 by Sae International.

* cited by examiner

*Primary Examiner*—Kevin P Kerns
(74) *Attorney, Agent, or Firm*—Husky Intellectual Property Services

(57) ABSTRACT

Disclosed is: (i) a metal molding system, (ii) a metal molding system including a combining chamber, (iii) a metal molding system including a first injection-type extruder and a second injection-type extruder, (iv) a metal molding system including a first injection-type extruder being co-operable with a second injection-type extruder, (v) a mold of a metal molding system, and (vi) a method of a metal molding system.

31 Claims, 7 Drawing Sheets

METAL MOLDING SYSTEM

TECHNICAL FIELD

The present invention generally relates to, but is not limited to, molding systems, and more specifically the present invention relates to, but is not limited to, (i) a metal molding system, (ii) a metal molding system including a combining chamber, (iii) a metal molding system including a first injection-type extruder and a second injection-type extruder, (iv) a metal molding system including a first injection-type extruder being co-operable with a second injection-type extruder, (v) a mold of a metal molding system, and (vi) a method of a metal molding system.

BACKGROUND

Examples of known molding systems are (amongst others): (i) the HyPET™ Molding System, (ii) the Quadloc™ Molding System, (iii) the Hylectric™ Molding System, and (iv) the HyMet™ Molding System, all manufactured by Husky Injection Molding Systems Limited (Location: Bolton, Ontario, Canada; www.husky.ca).

Metal injection molding (MIM) is a manufacturing process which combines the versatility of plastic injection molding with the strength and integrity of machined, pressed or otherwise manufactured small, complex, metal parts. The window of economic advantage in metal injection molded parts is such that the complexity and small size of the part or perhaps difficulty of fabrication through other means make it cost inefficient or impossible to manufacture otherwise. Increasing complexity for traditional manufacturing methods typically does not increase cost in a metal injection molding operation due to the wide range of features possible through injection molding (features such as: undercuts, thread both internal and external, miniaturization, etc.).

U.S. Pat. No. 4,694,881 (Inventor: Busk; Published: Sep. 22, 1987) discloses thixotropic alloy production by heating alloy above its liquids, cooling to between solidus and liquidus, and shearing in an extruder. More specifically, this patent appears to disclose a process for forming a liquid-solid composition from a material which, when frozen from its liquid state without agitation, forms a dendritic structure. A material having a non-thixotropic-type structure, in a solid form, is fed into an extruder. The material is heated to a temperature above its liquidus temperature. It is then cooled to a temperature less than its liquidus temperature and greater than its solidus temperature, while being subjected to sufficient shearing action to break at least a portion of the dendritic structures as they form. Thereafter, the material is fed out of the extruder.

U.S. Pat. No. 5,685,357 (Inventor: Kato et al; Published: Nov. 11, 1997) discloses metal molding manufacturing with good mechanical strength, the process includes melting solid metal in cylinder barrel of an injection molding machine. More specifically, this patent appears to disclose a metallic feed initially in a solid state that is fed into a cylinder barrel of an injection molding machine. The metallic feed is melted by applying heat to the metallic feed from outside the cylinder barrel and by heat produced from frictional and shearing forces generated by rotation of a screw housed within the cylinder barrel. The cylinder barrel and screw define at least a feed zone, a compression zone and an accumulating zone. After melting and passing through each of the three zones, the metallic feed is injected into a die, to thereby form a shaped part. The temperature of the metallic feed is controlled to be above the liquidus of the metallic feed during the injecting process.

U.S. Pat. No. 5,983,976 (Inventor: Kono; Published: Nov. 16, 1999) discloses injecting a molten material into a die-casting mold. More specifically, this patent appears to disclose an injection molding system that includes a feeder in which a metal is melted, and a first chamber into which a desired amount of melted metal is introduced. A piston in a second chamber first retracts to create suction, assisting in drawing in the melted metal into the second chamber from the first chamber and evacuating gas. A ram then pushes some melted metal remaining in the first chamber into the second chamber, forcing out gas present in the second chamber. The piston then injects the melted metal out of the second chamber into a mold. The melted metal is preferably maintained in a liquid state throughout the system.

U.S. Pat. No. 6,241,001 (Inventor: Kono; Published: Jun. 5, 2001) discloses manufacturing a light metal alloy for injection molding with desired characteristics of density in a consistent manner. More specifically, this patent appears to disclose an injection molding system for a metal alloy. The injection molding system includes a feeder in which the metal alloy is melted and a barrel in which the liquid metal alloy is converted into a thixotropic state. An accumulation chamber draws in the metal alloy in the thixotropic state through a valve disposed in an opening between the barrel and the accumulation chamber. The valve selectively opens and closes the opening in response to a pressure differential between the accumulation chamber and the barrel. After the metal alloy in the thixotropic state is drawn in, it is injected through an exit port provided on the accumulation chamber. The exit port has a variable heating device disposed around it. This heating device cycles the temperature near the exit port between an upper limit and a lower limit. The temperature is cycled to an upper limit when the metal alloy in the thixotropic state is injected and to a lower limit when the metal alloy in the thixotropic state is drawn into the accumulation chamber from the barrel.

U.S. Pat. No. 6,789,603 (Inventor: Kono; Published: Sep. 14, 2004) discloses injection molding of metal (such as magnesium alloy) that includes the following steps: (i) providing a solid metal into melt feeder, (ii) melting the solid metal into a liquid state, (iii) providing the liquid metal into an inclined metering chamber, (iv) metering metal, and (v) injecting the metal into a mold. More specifically, this patent appears to disclose metal injection molding method, that includes the following steps: (i) providing solid metal into a melt feeder, (ii) melting the solid metal into a liquid state, such that a fill line of the liquid metal is below a first opening between an inclined metering chamber and a first driving mechanism, (iii) providing the liquid metal into the inclined metering chamber containing the first driving mechanism attached to an upper portion of the metering chamber, (iv) metering the metal from the metering chamber into an injection chamber located below a lower portion of the metering chamber, and (v) injecting the metal from the injection chamber into a mold.

U.S. Pat. No. 7,066,236 (Inventor: Fujikawa; Published: Jun. 27, 2006) discloses an injection device for a light metal injection molding machine, which extrudes molten metal formed by fusing a cylinder from inserted billets, and injects molten metal when billets are passed through connection element. More specifically, this patent appears to disclose an injection device for a light metal injection molding machine that includes: (i) a melting device for melting light metal material into molten metal, (ii) a plunger injection device for carrying out injection of molten metal using a plunger after the molten metal is metered into an injection cylinder from the melting device, (iii) a connecting member including a connecting passage for connecting the melting device and the plunger injection device, and (iv) a backflow prevention device for preventing backflow of molten metal by opening and closing the connecting passage.

A technical article (published in 2004 by Elsevier B. V.; titled "*The generation of Mg—Al—Zn alloys by semisolid state mixing of particulate precursors*"; authored by Frank Czerwinski; published in a technical journal called Acta Materialia 52 (2004) 5057-5069) discloses a number of Mg—Al—Zn alloys with thixotropic microstructures that were created by the semisolid mixing of AZ91D and AM60B mechanically comminuted precursors in a thixomolding system. The microstructure formation was analyzed along with the role of structural constituents in controlling strength, ductility and the fracture behavior of the created alloy. It was found that the inhomogeneity in the partition of alloying elements intensified with a reduction in the processing temperature and the liquid fraction was highly influenced by the alloy with the lower melting range. Tensile strength showed a strong correlation with corresponding elongations and was predominantly controlled by the solid particles' content in the microstructure, with negligible influence derived from changes in the alloy's chemistry. Although elongation was affected by both the solid content and the alloy's chemical composition, a larger role was still exerted by the former. The contribution of individual precursors to the tensile properties of the created alloy depended on the processing temperature. While near to complete melting, both of them contributed almost equally; with a temperature reduction, the deviation from the rule of mixtures enlarged, and properties were increasingly influenced by the precursor with the lower melting range.

A technical article (published in 2005 by Elsevier B. V.; titled "*A novel method of alloy creation by mixing thixotropic slurries*"; authored by Frank Czerwinski; published in a technical journal called Materials Science and Engineering A 404 (2005) 19-25) discloses the concept of semisolid processing to generate alloys by mixing coarse particulate precursors with different chemistries. Experiments with several magnesium alloys revealed that the control of chemistry and the proportion of precursors, as well as the solid to liquid ratio during their partial melting, allowed the selective partition of alloying elements between the solid and liquid phases, thus designing unique solidification microstructures.

A technical article (published in 2005 by SAE International; titled "*The Concept and Technology of Alloy Formation During Semisolid Injection Molding*"; authored by Frank Czerwinski; published in a technical journal called SAE Technical Paper Series) discloses the application of semisolid technologies for processing magnesium alloys. The benefits of using the semisolid state and processing capabilities of Husky's thixosystem are introduced. The main attention is focused on exploring Thixomolding® for the generation of alloys by the mixing and partial melting of particulate precursors with different chemistries. Experiments with magnesium-based precursors revealed that the partition of alloying elements between the liquid matrix and remaining primary solid as well as the microstructure of created alloys were controlled by the processing temperature.

SUMMARY

According to a first aspect of the present invention, there is provided a metal molding system, including: a combining chamber configured to: (i) receive a first alloy being injectable under pressure from a first injection-type extruder, (ii) receive a second alloy being injectable under pressure from a second injection-type extruder, the alloys combining under pressure, at least in part, so as to form a third alloy in the combining chamber, and (iii) communicate, under pressure, the third alloy to a mold gate leading to a mold cavity defined by a mold, the third alloy solidifying and forming a molded article in the mold cavity.

According to a second aspect of the present invention, there is provided a metal molding system, including: a first injection-type extruder configured to process a first alloy, and also including a second injection-type extruder configured to process a second alloy, the first injection-type extruder and the second injection-type extruder configured to couple to a combining chamber, the combining chamber configured to: (i) receive the first alloy being injectable under pressure from the first injection-type extruder, (ii) receive the second alloy being injectable under pressure from the second injection-type extruder, the first alloy and the second alloy combining under pressure, at least in part, so as to form a third alloy in the combining chamber, and (iii) communicate, under pressure, the third alloy to a mold gate leading to a mold cavity defined by a mold, the third alloy solidifying and forming a molded article in the mold cavity.

According to a third aspect of the present invention, there is provided a metal molding system, including a first injection-type extruder configured to process a first alloy, the first injection-type extruder being co-operable with a second injection-type extruder configured to process a second alloy, the first injection-type extruder and the second injection-type extruder configured to couple to a combining chamber, the combining chamber configured to: (i) receive the first alloy being injectable under pressure from the first injection-type extruder, (ii) receive the second alloy being injectable under pressure from the second injection-type extruder, the first alloy and the second alloy combining under pressure, at least in part, so as to form a third alloy in the combining chamber, and (iii) communicate, under pressure, the third alloy to a mold gate leading to a mold cavity defined by a mold, the third alloy solidifying and forming a molded article in the mold cavity.

According to a fourth aspect of the present invention, there is provided a metal molding system, including: (a) a first injection-type extruder configured to process a first alloy, (b) a second injection-type extruder configured to process a second alloy, (c) a stationary platen configured to support a stationary mold portion of a mold, (d) a movable platen configured to move relative to the stationary platen, and configured to support a movable mold portion of the mold, the stationary mold portion and the movable mold portion forming a mold cavity once the movable platen is made to move toward the stationary platen sufficiently enough as to abut the stationary mold portion against the movable mold portion, the stationary mold portion defining a mold gate leading to the mold cavity, (e) a clamping structure coupled to the stationary platen and the movable platen, and configured to apply a clamp tonnage between the stationary platen and the movable platen, and (f) a combining chamber configured to: (i) receive the first alloy being injectable under pressure from the first injection-type extruder, and (ii) receive the second alloy being injectable under pressure from the second injection-type extruder, the first alloy and the second alloy combining, at least in part, so as to form a third alloy in the combining chamber, and (iii) communicate, under pressure, the third alloy to the mold gate leading to the mold cavity defined by the mold, the third alloy solidifying and forming a molded article in the mold cavity, the molded article being releasable from the mold after: (i) the clamping structure has ceased applying the clamp tonnage between the movable platen and the stationary platen, and (ii) the movable platen has been moved away from the stationary platen so as to separate the stationary mold portion from the movable mold portion.

According to a fifth aspect of the present invention, there is provided a mold of a metal molding system, including a mold body configured to mold a molded article, the molded article made by usage of a metal molding system, the molded article including: (i) a first alloy, and (ii) a second alloy combined, at least in part, with the first alloy so as to form a third alloy, the third alloy solidified and formed in a mold cavity of the mold.

According to a sixth aspect of the present invention, there is provided a method of a metal molding system, including: (i) receiving a first alloy being injectable under pressure from a first injection-type extruder, and receiving a second alloy being injectable under pressure from a second injection-type extruder, the first alloy and the second alloy combining, at least in part, so as to form a third alloy, the third alloy to be communicated, under pressure, to a mold gate leading to a mold cavity defined by a mold, the third alloy solidifying and forming a molded article in the mold cavity.

According to a seventh aspect of the present invention, there is provided a method of a metal molding system, including (i) receiving a first alloy being injectable under pressure from a first injection-type extruder, (ii) receiving a second alloy being injectable under pressure from a second injection-type extruder, the first alloy and the second alloy combining, at least in part, so as to form a third alloy, and (iii) communicating, under pressure, the third alloy to a mold gate leading to a mold cavity defined by a mold, the third alloy solidifying and forming a molded article in the mold cavity.

According to an eighth aspect of the present invention, there is provided a method of a metal molding system, including: (i) receiving, in a combining chamber, a first alloy being injectable under pressure from a first injection-type extruder, (ii) receiving, in the combining chamber, a second alloy being injectable under pressure from a second injection-type extruder, the first alloy and the second alloy combining, at least in part, so as to form a third alloy in the combining chamber, and (iii) communicating the third alloy, under pressure, from the combining chamber to a mold gate leading to a mold cavity defined by a mold, the third alloy solidifying and forming a molded article in the mold cavity.

According to a ninth aspect of the present invention, there is provided a metal molding system, including a combining chamber configured to: (i) receive a plurality of alloys being injectable under pressure from respective injection-type extruders, the plurality of alloys combining under pressure, at least in part, so as to form a combined alloy in the combining chamber, and (ii) communicate, under pressure, the combined alloy to a mold gate leading to a mold cavity defined by a mold, the combined alloy solidifying and forming a molded article in the mold cavity.

According to a tenth aspect of the present invention, there is provided a metal molding system, including a combining chamber configured to receive a plurality of alloys being injectable under pressure into the combining chamber, the plurality of alloys combining under pressure, at least in part, so as to form a combined alloy in the combining chamber.

According to an eleventh aspect of the present invention, there is provided a metal molding system, including a combining chamber configured to: (i) receive a first alloy being injectable under pressure into the combining chamber, and (ii) receive a second alloy being injectable under pressure into the combining chamber, the first alloy and the second alloy combining under pressure, at least in part, so as to form a third alloy in the combining chamber.

According to a twelfth aspect of the present invention, there is provided a metal molding system, including a combining chamber configured to: (i) receive a first alloy being injectable under pressure into the combining chamber, (ii) receive a second alloy being injectable under pressure into the combining chamber, the first alloy and the second alloy combining under pressure, at least in part, so as to form a third alloy in the combining chamber, and (iii) communicate, under pressure, the third alloy to a mold gate leading to a mold cavity defined by a mold, the third alloy solidifying and forming a molded article in the mold cavity.

A technical effect, amongst other technical effects, of the aspects of the present invention is improved operation of a molding system for manufacturing articles molded of metallic alloys.

DESCRIPTION OF THE DRAWINGS

A better understanding of the exemplary embodiments of the present invention (including alternatives and/or variations thereof) may be obtained with reference to the detailed description of the exemplary embodiments of the present invention along with the following drawings, in which.

The drawings are not necessarily to scale and are sometimes illustrated by phantom lines, diagrammatic representations and fragmentary views. In certain instances, details that are not necessary for an understanding of the embodiments or that render other details difficult to perceive may have been omitted.

DETAILED DESCRIPTION OF THE EXEMPLARY EMBODIMENTS

Figure 1:
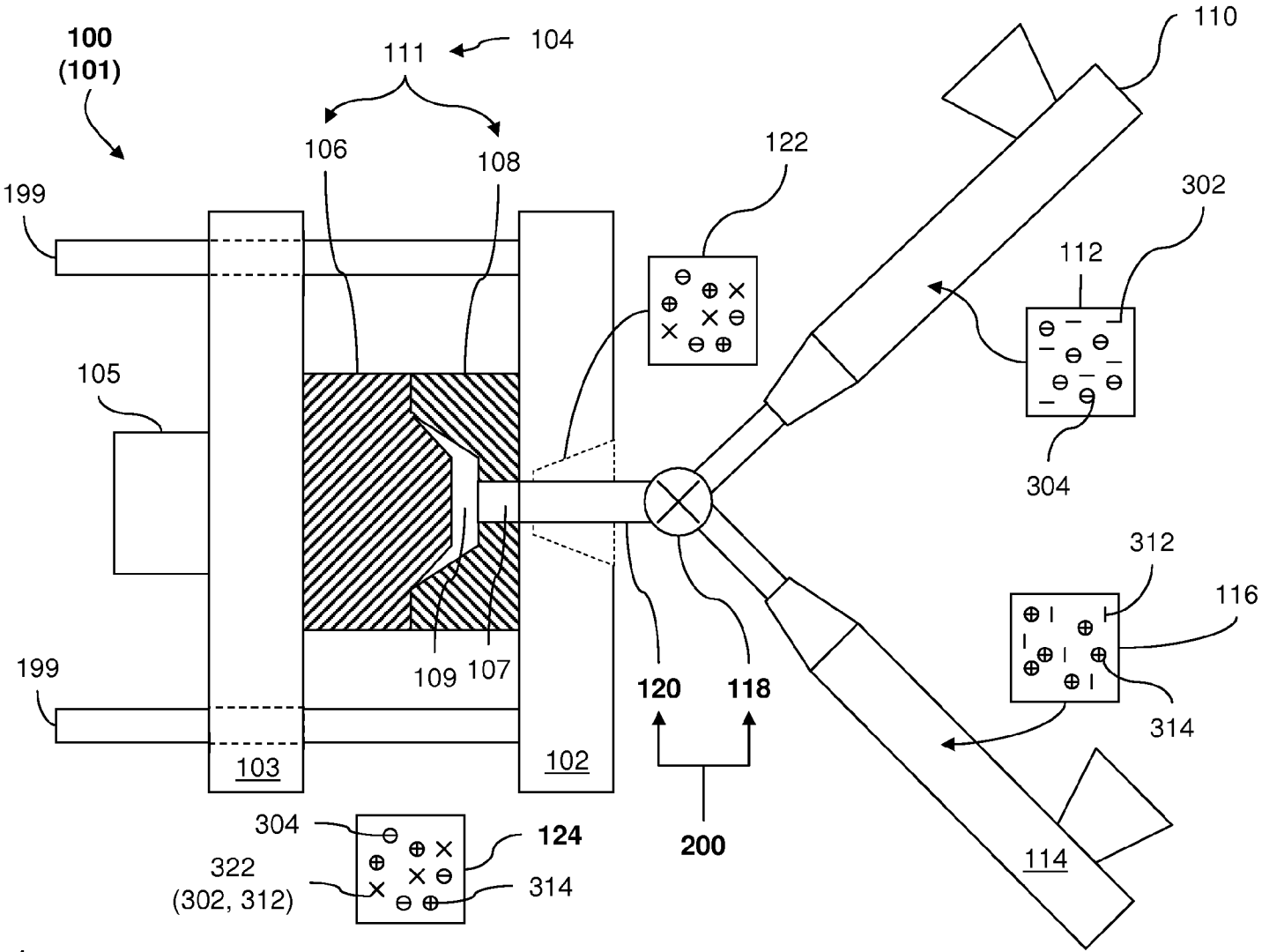
FIG. 1 is a schematic representation of a metal molding system according to a first exemplary embodiment (which is the preferred embodiment)

FIG. 1 is the schematic representation of a metal molding system (hereafter referred to as the "system 100") according to the first exemplary embodiment. Preferably, the system 100 includes a metal-injection molding system 101. The system 100 includes components that are known to persons skilled in the art and these known components will not be described here; these known components are described, at least in part, in the following text books (by way of example): (i) Injection Molding Handbook by Osswald/Turng/Gramann (ISBN: 3-446-21669-2; publisher: Hanser), and (ii) Injection Molding Handbook by Rosato and Rosato (ISBN: 0-412-99381-3; publisher: Chapman & Hill). According to the first embodiment, the system 100 includes a first injection-type extruder 110 (hereafter referred to as the "extruder 110") that is configured to process a first alloy 112. The first alloy 112 may also be called an input alloy, but is hereafter referred to as the "alloy 112". The alloy 112 includes any one of: (i) a combination of a liquid component 302 and a solid component 304 (particulates for example) held in the liquid component 302, (ii) only the liquid component 302, or (iii) only the solid component 304 (in the form of flowable particulates). The system 100 also includes a second injection-type extruder 114 (hereafter referred to as the "extruder 114") that is configured to process a second alloy 116. The second alloy 116 may also be called an input alloy, but is hereafter referred to as the "alloy 116". The alloy 116 includes any one of: (i) a combination of a liquid component 312 and a solid component 314 (particulates for example) held in the liquid component 312, (ii) only the liquid component 312, or (iii) only the solid component 314 (in the form of flowable particulates). The alloy 112 and the alloy 116 may be collectively referred to as "alloys 112, 116". The extruder 110 and the extruder 114 each include: (i) respective reciprocating screws (not depicted in FIG. 1, but depicted in FIGS. 6 and 7 by way of example) that are mounted in their respective barrels of the extruder 110 and the extruder 114, and (ii) respective hoppers configured to receive solidified particles of molding material and that are attached to the feed throats of their respective barrels. The system 100 also includes a stationary platen 102 that is configured to support a stationary mold portion 108 of a mold 104. The system 100 also includes a movable platen 103 that is configured to: (i) move relative to the stationary platen 102, and (ii) support a movable mold portion 106 of the mold 104. The mold 104 is usually supplied separately from the system 100. The mold 104 includes a mold body 111 that has the stationary mold portion 108 and the movable mold portion 106 that in combination define a mold cavity 109 once the movable platen 103 is made to move toward the stationary platen 102 sufficiently enough as to abut the stationary mold portion 108 against the movable mold portion 106. The stationary mold portion 108 defines a mold gate 107 that leads to the mold cavity 109. The system 100 also includes a clamping mechanism 105 that is coupled to: (i) the stationary platen 102 (via the tie bars 199), and (ii) the movable platen 103. Specifically, the tie bars 199 are: (i) connected to the stationary platen 102, and (ii) extend to the movable platen 103. The tie bars 199 are lockably engageable and disengageable to the movable platen 103 by locking mechanisms (not depicted) that are well known to those skilled in the art (and therefore will not be described in the instant patent application). The movable platen 103 may be used to house or support the locking mechanisms at respective corners of the movable platen 103. The tie bars 199 assist in coupling the clamping mechanism 105 to the stationary platen 102 when the locking mechanisms lock the tie bars 199 to the movable platen 103. Once the platens 102, 103 are stroked so as to close the mold 104, the locking mechanisms are engaged, the clamping mechanism 105 may then be engaged so as to apply a clamp tonnage (also called a clamping force) to the platens 102, 103 and in this manner the clamp tonnage may be applied to the mold 104; since this process is known to those skilled in the art, this process is not fully described in the instant patent application. The tie bars 199 will not be depicted in the remaining FIGS. for the sake of simplifying the remaining FIGS.

The system 100 also includes a combining chamber 200 (hereafter referred to as the "chamber 200"). It will be appreciated that the system 100 and the chamber 200 may be supplied or sold separately or sold integrated. The chamber 200 is configured to: (i) receive the alloy 112 that is injectable under pressure from the extruder 110, and (ii) receive the alloy 116 that is injectable under pressure from the extruder 114 so that, in effect, the alloy 112 and the alloy 116 combine, at least in part, to form a combined alloy 122 in the chamber 200. The combined alloy 122 may be called an output alloy, but is hereafter referred to as the "alloy 122". The chamber 200 is also configured to: (iii) communicate, under pressure, the alloy 122 to the mold gate 107 that leads to the mold cavity 109 that is defined by the mold 104 that is supported by the platens 102, 103. The alloy 112 and the alloy 116 may be collectively referred to a "plurality of alloys 112, 116" or the "alloys 112, 116", in that at least two or more alloys may be combined in the chamber 200. The alloy 122 includes any one combination of: (i) a combination of a liquid component 322, the solid component 304, and the solid component 314, (ii) a combination of the liquid component 322, the solid component 304, (iii) a combination of the liquid component 322 and the solid component 314, (iv) only the liquid component 322, (v) a combination of only the solid component 304, (vi) only the solid component 314, (vii) the solid component 304 and the solid component 314, and any other possible combination and permutation not mentioned above. The liquid component 322 includes any one combination of: (i) only the liquid component 302, (ii) only the liquid component 312 or (iii) the liquid component 302 and the liquid component 312. Preferably, the chamber 200 includes a mixing element (not depicted) that is used to improve the mixing of the alloy 112 and the alloy 116 in the chamber 200.

If a die-casting process is used to mix alloys, a layer of sludge may form on top of a die-casting bath. The layer of sludge is an undesirable condition because if mixing were to occur between the sludge and the mixing alloys within the bath, the sludge may become inadvertently mixed with the combination of the input alloys. A technical effect that is derived by using the exemplary embodiments depicted in the FIGS, the possibility of forming the layer of sludge may be significantly reduced. In addition, as far as known to the inventors at the time of filing the instant patent application, there appears to be no commercially-viable mixing technology that is usable for mixing alloys in the die-casting bath.

Referring to FIG. 1, the alloy 112 and second alloy 116 are introduced into the extruder 110 and the extruder 114, respectively, as a flowable solid (that is, particles, pellets, flakes, etc). When the alloys 112, 116 are processed by their respective extruders 110, 114, the alloy 112 and the alloy 116 may include alloy ingredients of different chemistry. Preferably, the alloy 112 and the alloy 116 exist in a thixotropic state (sometimes referred to as the "semisolid state"), and the alloy 112 and second alloy 116 contain a mixture of liquid and solid particles of globular shape. Due to the semisolid state, the liquid chemistry is different than the average chemistry of individual alloys. In particular cases, one (or both) of the alloys 112, 116 may be in a completely molten state. The extruder 110 and the extruder 114 output the alloy 112 and the alloy 116 respectively in many different types of states, such as: (A) the alloy 112 is in a state of: (a) 100% liquid, (b) 100% flowable solid or (c) a combination of a liquid portion and a flowable solid portion (the combination is sometimes called thixotropic), (B) the alloy 116 is in a state of: (a) 100% liquid, (b) 100% flowable solid, or (c) a combination of: a liquid portion and a flowable solid portion (the combination is sometimes called thixotropic), and/or (C) any combination and permutation described above. A technical effect of this arrangement is that the alloy 122 may be manufactured according to specifically desired (predetermined) characteristics or attributes. As far as the inventors of the instant patent application are aware, the alloy 122 that has specific (desired) attributes cannot be made or achieved by using a die casting process as known today.

As first example, the extruder 110 outputs the alloy 112 that is in a state of: (i) 90% flowable solids mixed with (ii) 10% liquid, and the extruder 114 outputs the alloy 116 that is in a state of: (i) 35% flowable solids mixed with (ii) 65% liquid.

As a result, in the chamber 200, the alloy 122 of the first example is made that has a first set of characteristics or attributes. As a second example, the extruder 110 outputs the alloy 112 that is in a state of: (i) 15% flowable solids mixed with (ii) 85% liquid, and the extruder 114 outputs the alloy 116 that is in a state of: (i) 95% flowable solids mixed with (ii) 5% liquid. As a result, in the chamber 200, the alloy 122 of the second example has a second set of characteristics or attributes. The alloy 122 that is made in accordance to the combination of the first example has certain characteristics that are different from the characteristics associated with the alloy 122 that is made in accordance to the combination of the second example. The ability to manufacture alloys of varying characteristics (attributes) is a technical advantage of the aspects of the exemplary embodiments. If a die casting bath (according to the state of the art, as known to the inventors of the instant patent application) is used to combine alloys, the liquids of the different alloys have different densities and as such these alloys will tend to separate. As far as it is known and made aware to the inventors of the instant application, die casting processes associated with the state of the art do not use a mixing element in the bath for mixing the input alloys together, and it is believed that if they did, they would likely mix a layer of sludge into the alloys being mixed in the mixing bath.

While mixing the alloys 112, 116 that each exist in a thixotropic state (or alternatively mixing of a semisolid alloy 112 with a liquid alloy 116 for example), the alloy 122 has a thixotropic structure. After mixing two semisolid structures associated with the alloy 112 and second alloy 116, the alloy 122 that is created inherits a mixture of solid particles originated from the alloy 112 and second alloy 116. Due to relatively short molding time, the chemistry and internal structure of the alloy 122 does not differ much from that in the alloy 112 and the alloy 116. The matrix (of the alloy 122) is created as a simple mixing of liquid fractions derived from both the alloys 112, 116. Its chemistry is given by the rule of mixtures, that is: individual chemistries and volume fractions of ingredients. For example: if the alloy 116 is fully molten, the combined alloy 122 contains a matrix formed by a mixing of: (i) a liquid fraction from a semisolid ingredient associated with the alloy 116 and (ii) solid particles associated with the alloy 112.

Referring to FIG. 1, the alloy 122 solidifies and forms a molded article 124 in the mold cavity 109. The molded article 124 is releasable from the mold 104 after: (i) the clamping mechanism 105 has ceased applying the clamp tonnage between the movable platen 103 and the stationary platen 102 (this includes application of a mold break force to the mold 104 by usage of a mold break actuator which is known to those skilled in the art), and (ii) the movable platen 103 has been moved away from the stationary platen 102 so as to separate the stationary mold portion 108 from the movable mold portion 106. The molded article 124 may be ejected from the mold 104 by ejection mechanisms (not depicted, but known to those skilled in the art), or may be removed by a robot (not depicted, but known to those skilled in the art).

According to the first exemplary embodiment depicted in FIG. 1, the chamber 200 includes a combining valve 118 that configured to: (i) couple to the extruder 110, and (ii) couple to the extruder 114. The chamber 200 also includes a conduit 120 that is configured to: (i) couple to the combining valve 118, and (ii) couple to the mold gate 107 of the mold 104. The combining valve 118 is operable in a non-flow state, and a flow state. In the non-flow state, the combining valve 118 is configured to: (i) not receive the alloy 112 from the extruder 110, and (ii) not receive the alloy 116 from the extruder 114. In the flow state, the combining valve 118 is configured to: (i) receive the alloy 112 from the extruder 110, and (ii) receive the alloy 116 from the extruder 114. The alloy 112 and the alloy 116 combine, at least in part, to form the alloy 122 in the combining valve 118. The conduit 120 is configured to: (i) receive the alloy 122 from the combining valve 118, and (ii) communicate the alloy 122 to the mold gate 107 of the mold 104.

Figure 2:
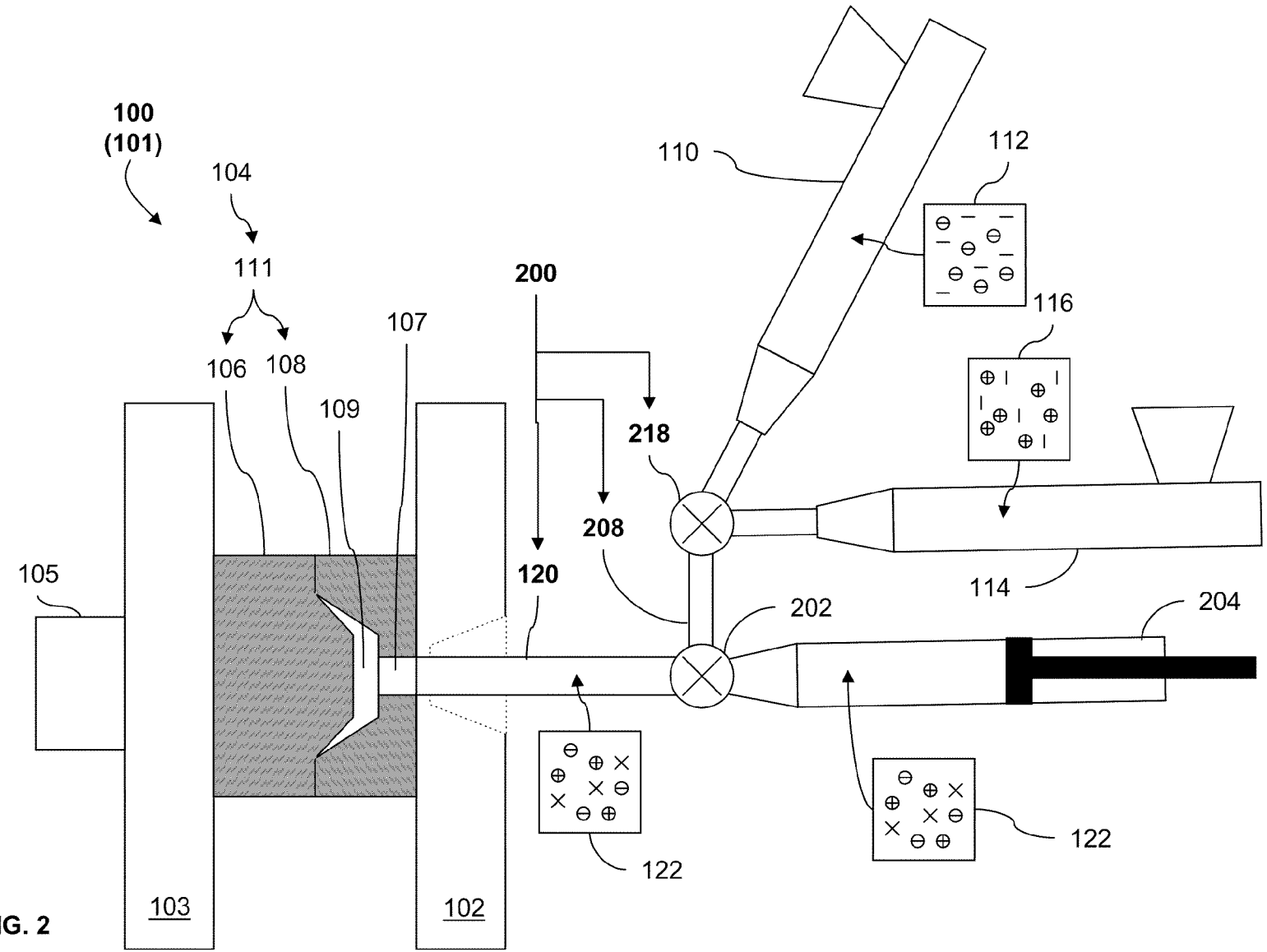
FIG. 2 is a schematic representation of a metal molding system according to a second exemplary embodiment.

FIG. 2 is the schematic representation of the system 100 according to the second exemplary embodiment. According to the second exemplary embodiment, the chamber 200 includes a combining valve 218 that is configured to: (i) couple to the extruder 110, and (ii) couple to the extruder 114. The chamber 200 also includes a channel 208 that is configured to couple to the combining valve 218. The chamber 200 also includes a shooting pot valve 202 that is configured to couple to the channel 208. The chamber 200 also includes a shooting pot 204 that is configured to couple to the shooting pot valve 202. The chamber 200 also includes a conduit 120 that is configured to couple to: (i) the shooting pot valve 202, and (ii) the mold gate 107 of the mold 104. The combining valve 218 is operable in a non-flow state, and a flow state. In the non-flow state, the combining valve 218 is configured to: (i) not receive the alloy 112 from the extruder 110, and (ii) not receive the alloy 116 from the extruder 114. In the flow state, the combining valve 218 is configured to: (i) receive the alloy 112 from the extruder 110, and (ii) receive the alloy 116 from the extruder 114. The alloy 112 and the alloy 116 combine, at least in part, to form the alloy 122 in the combining valve 218. The channel 208 is configured to receive the alloy 122 from the combining valve 218. The shooting pot valve 202 is operable in a first valve state, and a second valve state. In the first valve state, the shooting pot valve 202 is configured to not receive the alloy 122 from the channel 208. In the second valve state, the shooting pot valve 202 is configured to receive the alloy 122 from the channel 208. The shooting pot 204 is configured to receive the alloy 122 from the shooting pot valve 202 once the shooting pot valve 202 is placed in the second valve state, and the shooting pot valve 202 is configured to disconnect the channel 208 from the shooting pot 204 once the shooting pot valve 202 is placed in the first valve state. The conduit 120 is configured to: (i) receive the alloy 122 from shooting pot valve 202 once the shooting pot valve 202 is placed in the first valve state, and (ii) communicate the alloy 122 to the mold gate 107 of the mold 104.

Figure 3:
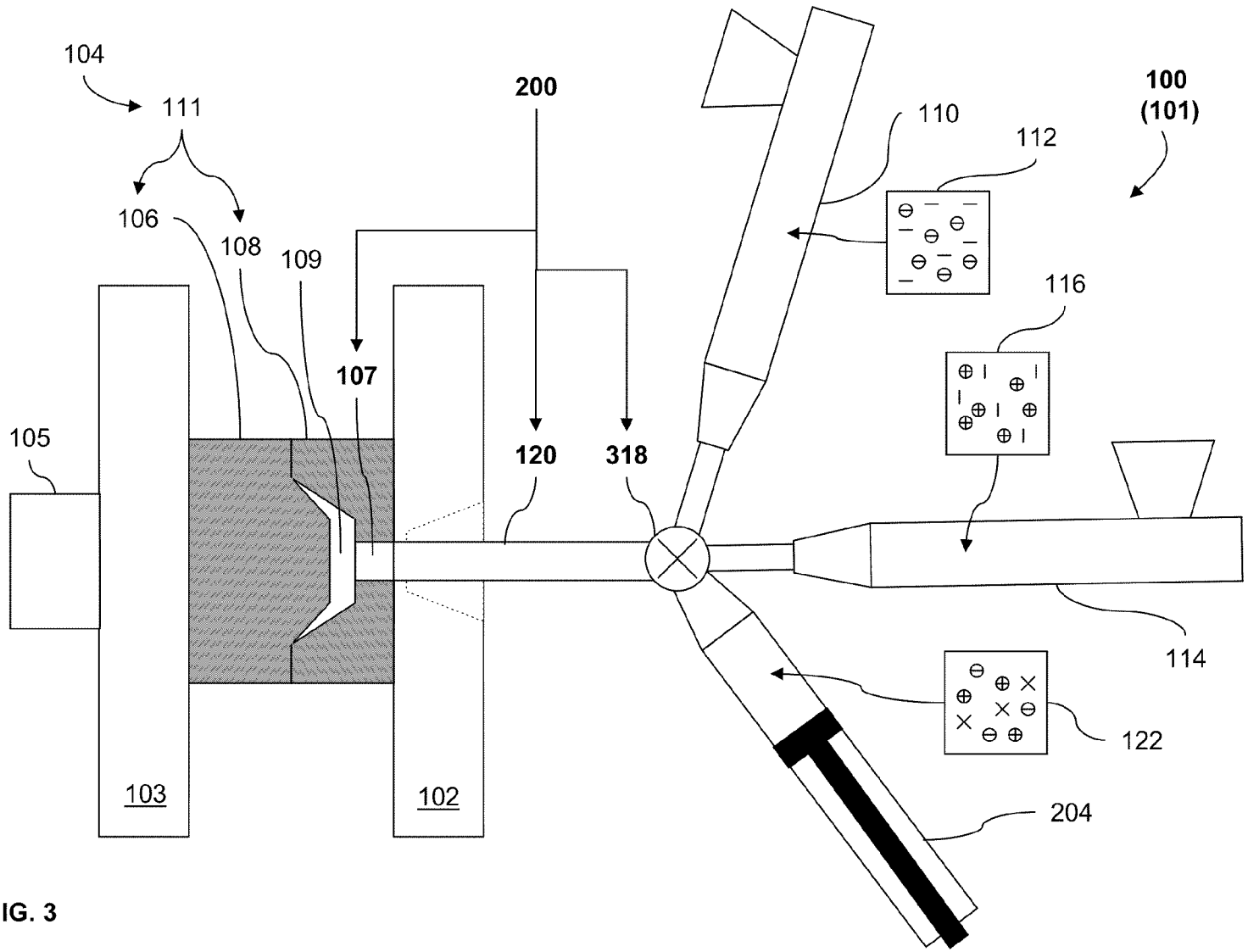
FIG. 3 is a schematic representation of a metal molding system according to a third exemplary embodiment.

FIG. 3 is the schematic representation of the system 100 according to the third exemplary embodiment. According to the third exemplary embodiment, the chamber 200 includes a combining valve 318 that is configured to: (i) couple to the extruder 110, (ii) couple to the extruder 114, and (iii) couple to a shooting pot 204. The chamber 200 also includes a conduit 120 that is coupled to: (i) the combining valve 318, and (ii) the mold gate 107 of the mold 104. The combining valve 318 is operable in a first state, and a second state. In the first state, the combining valve 318 is configured to: (i) receive the alloy 112 from the extruder 110, (ii) receive the alloy 116 from the extruder 114 (the alloy 112 and the alloy 116 combine, at least in part, to form the alloy 122 in the combining valve 318), and (iii) transmit the alloy 122 to a shooting pot 204. In the second state, the combining valve 318 is configured to: (i) not receive the alloy 112 from the extruder 110, (ii) not receive the alloy 116 from the extruder 114, and (iii) permit the shooting pot 204 to shoot the alloy 122 back into the combining valve 318. The conduit 120 is configured to: (i) communicate the alloy 122, under pressure, from the combining valve 318 to the mold gate 107 once the combining valve 318 is placed in the second state.

Figure 4:
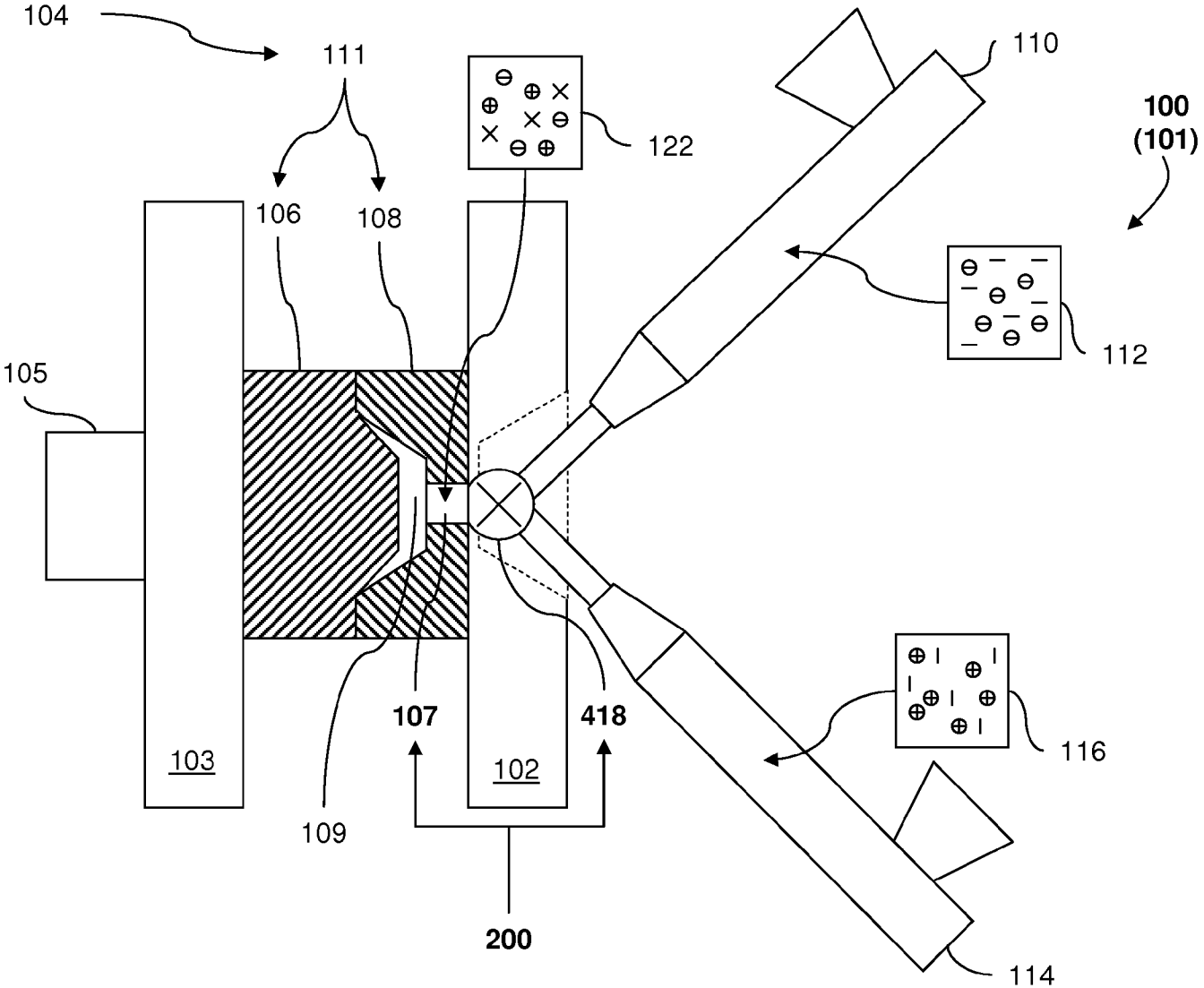
FIG. 4 is a schematic representation of a metal molding system according to a fourth exemplary embodiment.

FIG. 4 is the schematic representation of the system 100 according to the fourth exemplary embodiment. According to the fourth exemplary embodiment, the chamber 200 includes a combining valve 418 that is configured to: (i) couple to the extruder 110, (ii) couple to the extruder 114, and (iii) couple to the mold gate 107 of the mold 104. The combining valve 418 is operable in a first state, and a second state. In the first state, the combining valve 418 is configured to: (i) receive the alloy 112 from the extruder 110, (ii) receive the alloy 116 from the extruder 114 (the alloy 112 and the alloy 116 combine, at least in part, in the combining valve 418 so as to form the alloy 122), and (iii) communicate the alloy 122 to the mold gate 107 of the mold 104. In the second state, the combining valve 418 is configured to: (i) not receive the alloy 112 from the extruder 110, and (ii) not receive the alloy 116 from the second injection-type extruder 114.

According to another exemplary embodiment (not depicted), multiple extruders are used so as to combine multiple alloys into a single combined alloy, and in this exemplary embodiment, the system 100, includes the chamber 200 that is configured to receive a plurality of alloys being injectable under pressure from respective injection-type extruders. The plurality of alloys combine under pressure, at least in part, so as to form a combined alloy in the chamber 200. The chamber 200 is also configured to communicate, under pressure, the combined alloy to the mold gate 107 leading to the mold cavity 109 that is defined by the mold 104. The combined alloy solidifies and forms the molded article 124 in the mold cavity 109.

Figure 5:
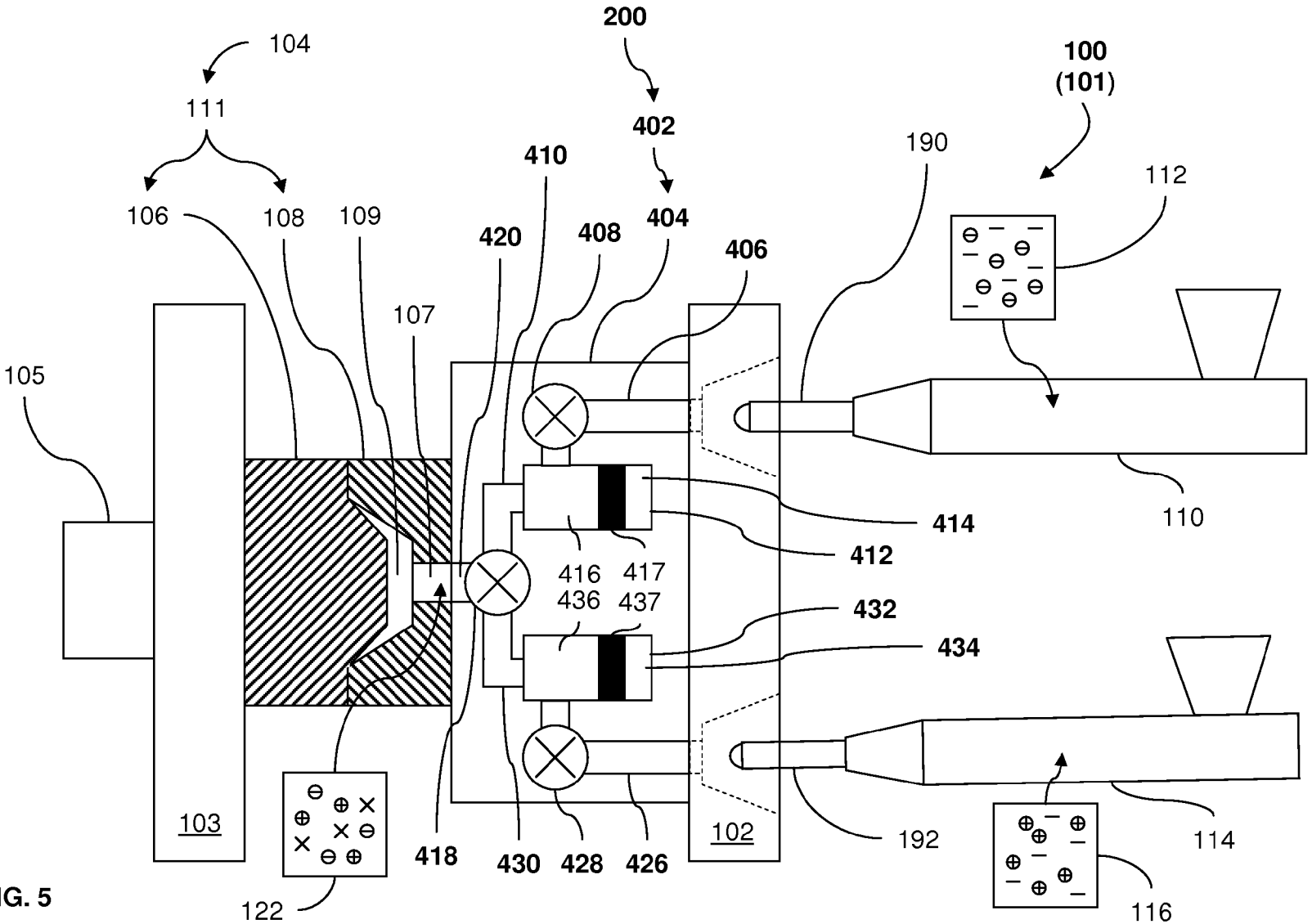
FIG. 5 is a schematic representation of a metal molding system according to a fifth exemplary embodiment.

FIG. 5 is the schematic representation of the system 100 according to the fifth exemplary embodiment. According to the fifth exemplary embodiment, the chamber 200 includes a hot runner 402. The hot runner 402 includes a manifold 404. The manifold 404 is configured to support: (i) switching valve 408 and switching valve 428, (ii) a shooting pot 412 and a shooting pot 432, and (iii) a combining valve 418. The shooting pot 412 and the shooting pot 432 may collectively be known as the "shooting pots 412, 432". The switching valve 408 and the switching valve 428 may collectively be known as the "switching valves 408, 428". The switching valve 408 and the switching valve 428 are coupled (via the conduits 406, 426 respectively) to the extruder 110 and the extruder 114 (respectively) so as to receive the alloy 112 and second alloy 116 from the extruder 110 and the extruder 114 respectively (that is, once the nozzle 190 and the nozzle 192 of the extruder 110 and the extruder 114, respectively, are made to contact the conduits 406, 426 respectively). Preferably, the nozzles 190, 192 are maintained in contact with their respective conduits 406, 426. The nozzles 190, 192 are depicted offset from the conduits 406, 426 respectively for illustration purposes. The shooting pot 412 and the shooting pot 432 are coupled to the switching valve 408 and the switching valve 428 respectively (preferably via conduits). The combining valve 418 is coupled to the shooting pot 412 and the shooting pot 432 (via the conduits 410, 430) and is also coupled to the mold gate 107 (via a conduit 420). A hot-runner nozzle (not depicted in this embodiment) may be inserted in the conduit 420 if so required to control the release of molding material (that is the alloy 122) into the mold cavity 109 of the mold 104. According to a variant, the switching valve 408 and switching valve 428 are on/off valves that are switchable (operable) between a non-flow state, and a flow state. According to another variant, the switching valve 408 and the switching valve 428 are on/off/variable-flow valves that are switchable (operable) between: (i) a non-flow state, (ii) a full-flow state, and (iii) a partial-flow state. According to a variant, the combining valve 418 is an on/off valve that is switchable (operable) between a non-flow state, and a flow state. According to another variant, the combining valve 418 is an on/off/variable valve that is switchable (operable) between a non-flow state, a full-flow state, and a partial-flow state.

The shooting pot 412 and the shooting pot 432 each include: (i) a pressure chamber 414 and a pressure chamber 434 respectively, (ii) an accumulation chamber 416 and an accumulation chamber 436 respectively, and (iii) a piston 417 and a piston 437 respectively that are each slidably movable between their respective accumulation chambers 416, 436. The pressure chamber 414 and the pressure chamber 434 may collectively be known as the "pressure chambers 414, 434". The pressure chambers 414, 434 are fillable with a pressurizable fluid, such as hydraulic oil. It will be appreciated that the shooting pot 412 and the shooting pot 432 may be actuated by electrical actuators (not depicted), etc. In operation, initially, the combining valve 418, the switching valve 408 and the switching valve 428 are placed in the non-flow state. The pressure chamber 414 and the pressure chamber 434 are de-pressurized so as to permit respective pistons 417, 437 to be movable. The extruder 110 and the extruder 114 process and prepare the alloy 112 and second alloy 116 respectively. After the extruder 110 and the extruder 114 have each prepared a respective shot of injectable molding material (that is, alloys 112, 116 respectively), the combining valve 418 remains in the non-flow state, and the switching valve 408 and the switching valve 428 are placed in the flow state, and then the extruders 110, 114 inject the alloys 112, 116, respectively, into the conduits 406, 426 respectively so that the alloy 112 and second alloy 116 may be injected, under pressure, into the accumulation chambers 416, 436 of the shooting pots 412, 432 respectively; as a result, the pistons 417, 437 are moved into the pressure chambers 414, 434 respectively so as to displace the pressurizable fluid out from the pressure chambers 414, 434 respectively. Once the extruder 110 and the extruder 114 have completed their injection cycle, the switching valve 408 and the switching valve 428 are placed in the non-flow state, the combining valve 418 is placed in the flow state (either full-flow or partial flow, etc, as may be required to achieve a desired combination of the alloy 112 and second alloy 116), and the pressure chambers 414, 434 are pressurized (that is, filled with the pressurizable fluid); as a result, the pistons 417, 437 are moved into their respective accumulation chambers 416, 436 respectively so as to inject or push the alloys 112, 116 respectively into the combining valve 418. The alloy 112 and second alloy 116 become combined, at least in part in the combining valve 418, to form the alloy 122. The alloy 122 then is pushed under pressure through the conduit 420 into the mold gate 107. The combining valve 418 may be used so as to combine a desired ratio of the alloy 112 and second alloy 116. The switching valve 408 and the switching valve 428 may be used so as to permit a desired amount of flow of the alloy 112 and second alloy 116 into the accumulation chambers 416, 436 respectively (as may be required). It will be appreciated that a single drop (that is, the conduit 420) is depicted, and that the exemplary embodiment may be modified to operate with a plurality of drops that all lead into a single mold cavity, or that lead into respective mold cavities that are not depicted.

Figure 6:
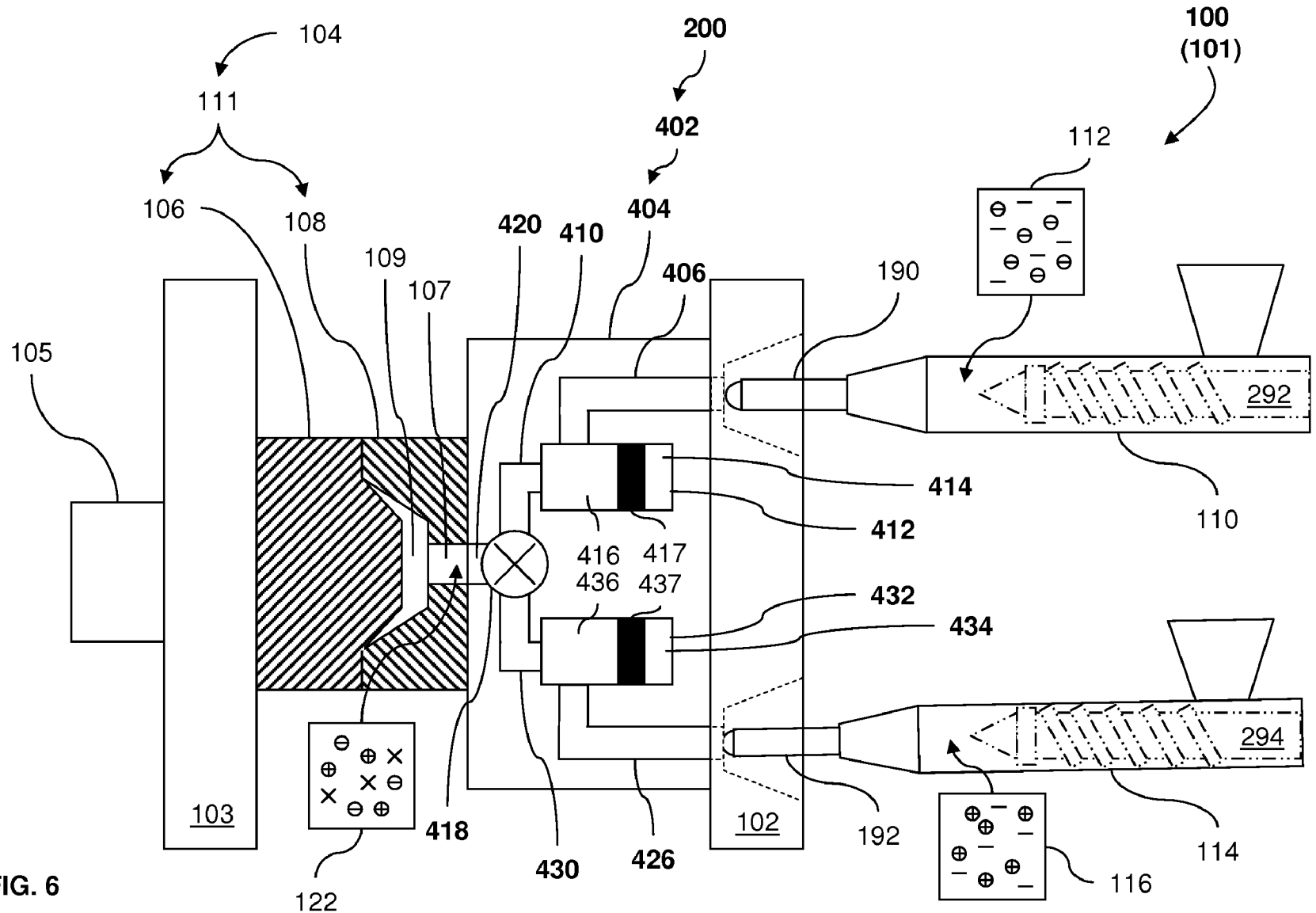
FIG. 6 is a schematic representation of a metal molding system according to a sixth exemplary embodiment.

FIG. 6 is the schematic representation of the system 100 according to the sixth exemplary embodiment. According to the sixth exemplary embodiment, the manifold 404 is configured to support: (i) the shooting pot 412 and the shooting pot 432, and (iii) the combining valve 418. The shooting pots 412, 432 are coupled to the extruders 110, 114 (respectively) so as to receive the alloys 112, 116 from the extruders 110, 114 respectively. The combining valve 418 is coupled to: (i) the shooting pots 412, 432, and (ii) the mold gate 107. The switching valves 408, 428 of the fifth exemplary embodiment are not used in the sixth exemplary embodiment. In operation, the combining valve 418 is operated in the non-flow state, and the extruder 110 and the extruder 114 accumulate their respective shots of alloys and then inject the alloy 112 and second alloy 116 respectively into the accumulation chambers 416, 436 (so that in effect, the shots of the alloys are transferred into the accumulation chambers 416, 436). Once the shots of the alloys are received into the accumulation chambers 416, 436, screws 292, 294 of the extruders 110, 114 respectively maintain their positions so as to prevent flow of the alloys 112, 116 back into the extruders 110, 114 respectively, and the combining valve 418 is placed in the flow state. The pressure chamber 414 and the pressure chamber 434 are pressurized so as to move their respective pistons 417, 437 into the accumulation chambers 416, 436 respectively so as to inject or push the alloys 112, 116 from the accumulation chambers 416, 436 respectively into the combining valve 418. A hot-runner nozzle (not depicted) may be inserted in the conduit 420 if so required to control the release of molding material into the mold cavity 109 of the mold 104. It will be appreciated that a single drop (that is, conduit 420) is depicted and that the exemplary embodiment may be modified to operate with a plurality of drops that lead into the mold cavity 109 (or that lead into respective mold cavities that are not depicted).

Figure 7:
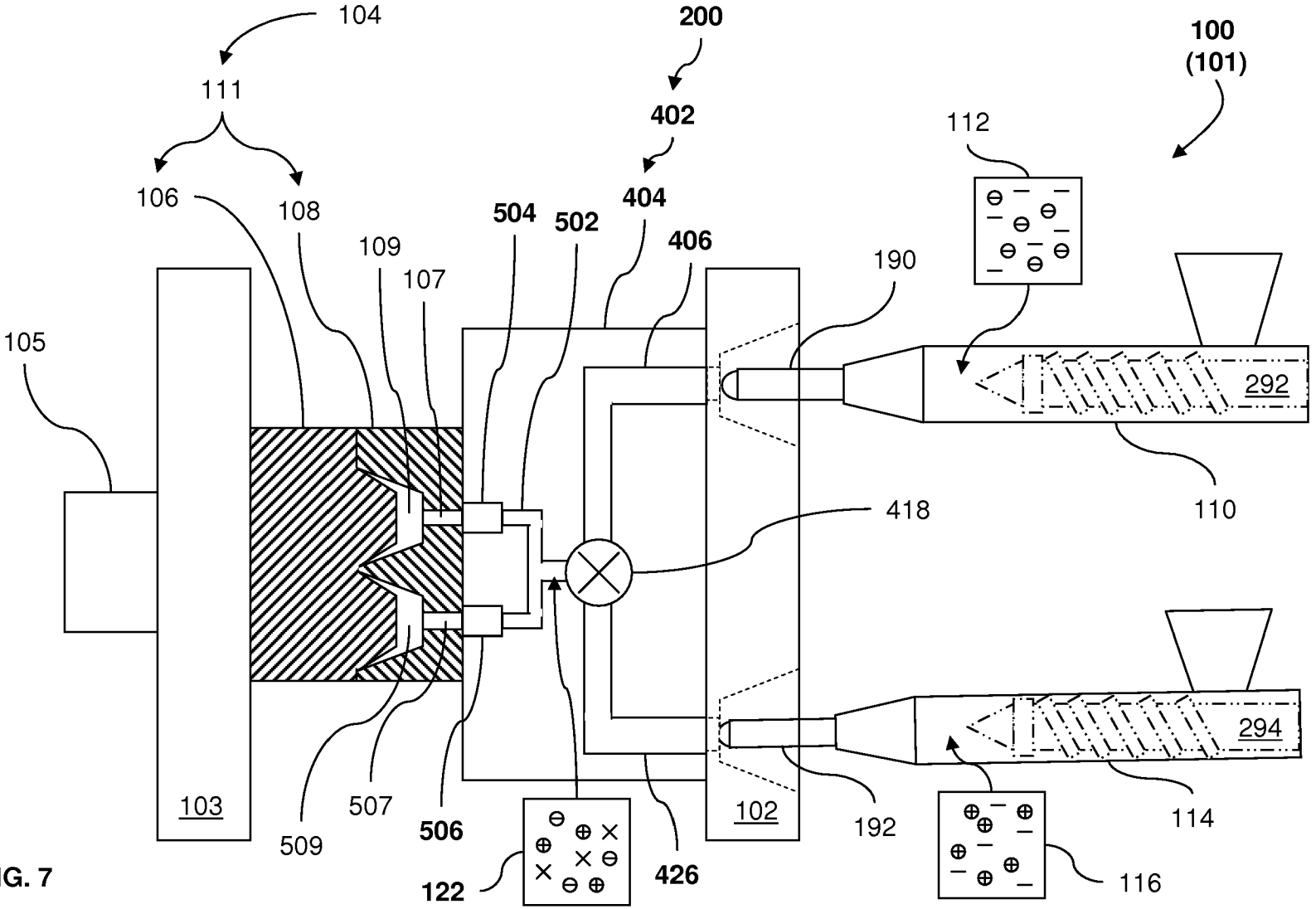
FIG. 7 is a schematic representation of a metal molding system according to a seventh exemplary embodiment.

FIG. 7 is the schematic representation of the system 100 according to the seventh exemplary embodiment. According to the seventh exemplary embodiment, the mold 104 defines the mold cavity 109 and the mold cavity 509. The mold cavities 109, 509 may be known collectively as mold cavities 109, 509. Associated with each of the mold cavities 109, 509 is the mold gate 107 and a mold gate 507, respectively, that each lead to the mold cavity 109 and the mold cavity 509 respectively. The manifold 404 supports the nozzles 504, 506 (sometimes referred to as "hot runner nozzles") that are coupled (via the conduit 502) to the combining valve 418, and also coupled to respective mold gates 107, 507. In operation, the alloy 112 and second alloy 116 combine to form the alloy 122 (at least in part) in the combining valve 418, the conduit 502, and the nozzles 504, 506.

The description of the exemplary embodiments provides examples of the present invention, and these examples do not limit the scope of the present invention. It is understood that the scope of the present invention is limited by the claims. The exemplary embodiments described above may be adapted for specific conditions and/or functions, and may be further extended to a variety of other applications that are within the scope of the present invention. Having thus described the exemplary embodiments, it will be apparent that modifications and enhancements are possible without departing from the concepts as described. It is to be understood that the exemplary embodiments illustrate the aspects of the invention. Reference herein to details of the illustrated embodiments is not intended to limit the scope of the claims. The claims themselves recite those features regarded as essential to the present invention. Preferable embodiments of the present invention are subject of the dependent claims. Therefore, what is to be protected by way of letters patent are limited only by the scope of the following claims

What is claimed is:

1. A metal molding system, comprising:

a combining chamber configured to receive alloys being injectable under pressure into the combining chamber, the alloys combining under pressure, at least in part, so as to form a combined alloy in the combining chamber, wherein the combining chamber further includes:

a combining valve configured to couple to injection-type extruders;

a channel configured to couple to the combining valve;

a shooting pot valve configured to couple to the channel;

a shooting pot configured to couple to the shooting pot valve; and a conduit configured to couple to:

(i) the shooting pot valve, and (ii) a mold gate leading to a mold cavity defined by a mold.

2. The metal molding system of claim 1, wherein the combining chamber includes a mixing element configured to mix the alloys.

3. The metal molding system of claim 1, wherein the alloys are injectable under pressure from the injection-type extruders respectively that are coupled to the combining chamber.

4. The metal molding system of claim 1, wherein the combining chamber is configured to communicate, under pressure, the combined alloy to the mold gate leading to the mold cavity defined by a mold body of the mold, the combined alloy solidifying and forming a molded article in the mold cavity.

5. The metal molding system of claim 1, wherein:

the combining valve is configured to: (i) couple to a first injection-type extruder, and (ii) couple to a second injection-type extruder; and the conduit is configured to: (i) couple to the combining valve, and (ii) couple to the mold gate leading to the mold cavity defined by the mold.

6. The metal molding system of claim 1, wherein:

the combining valve has a non-flow state and a flow state, in the non-flow state, the combining valve is configured to: (i) not receive the alloys from respective injection-type extruders, and in the flow state, the combining valve is configured to: (i) receive the alloys from the respective injection-type extruders, the alloys combining, at least in part, to form the combined alloy in the combining valve; and the conduit is configured to: (i) receive the combined alloy from the combining valve, and (ii) communicate the combined alloy to the mold gate leading to the mold cavity defined by the mold.

7. The metal molding system of claim 1, wherein:

the combining valve has a non-flow state and a flow state, in the non-flow state, the combining valve is configured to: (i) not receive the alloys from respective injection-type extruders, in the flow state, the combining valve is configured to: (i) receive the alloys from the respective injection-type extruders, the alloys combining, at least in part, to form the combined alloy in the combining valve;

the channel is configured to receive the combined alloy from the combining valve;

the shooting pot valve has a first valve state and a second valve state, in the first valve state, the shooting pot valve is configured to not receive the combined alloy from the channel, and in the second valve state, the shooting pot valve is configured to receive the combined alloy from the channel;

the shooting pot is configured to receive the combined alloy from the shooting pot valve once the shooting pot valve is placed in the second valve state, and the shooting pot valve is configured to disconnect the channel from the shooting pot once the shooting pot valve is placed in the first valve state; and the conduit is configured to: (i) receive the combined alloy from the shooting pot valve once the shooting pot valve is placed in the first valve state, and (ii) communicate the combined alloy to the mold gate leading to the mold cavity defined by the mold.

8. The metal molding system of claim 1, wherein:

the combining valve is configured to: (i) couple to injection-type extruders, and (ii) couple to the shooting pot; and the conduit coupled to: (i) the combining valve, and (ii) the mold gate leading to the mold cavity defined by the mold.

9. The metal molding system of claim 1, wherein:

the combining valve has a first state and a second state, in the first state, the combining valve is configured to: (i) receive the alloys from respective injection-type extruders, the alloys combining, at least in part, to form the combined alloy in the combining valve, and (ii) transmit the combined alloy to the shooting pot, in the second state, the combining valve is configured to: (i) not receive the alloys from the respective injection-type extruders, and (ii) permit the shooting pot to shoot the combined alloy back into the combining valve; and the conduit is configured to: (i) communicate the combined alloy, under pressure, from the combining valve to the mold gate once the combining valve is placed in the second state, the mold gate leads to the mold cavity defined by the mold.

10. The metal molding system of claim 1, wherein:

the combining valve is configured to: (i) couple to injection-type extruders, and (ii) couple to the mold gate leading to the mold cavity defined by the mold.

11. The metal molding system of claim 1, wherein:

the combining valve has a first state and a second state, in the first state, the combining valve is configured to: (i) receive the alloys from respective injection-type extruders, the alloys combining, at least in part, in the combining valve so as to form the combined alloy, and (ii) communicate the combined alloy to the mold gate leading to the mold cavity defined by the mold, and in the second state, the combining valve is configured to: (i) not receive the alloys from the respective injection-type extruders.

12. The metal molding system of claim 1, wherein the metal molding system includes a metal-injection molding system.

13. The metal molding system of claim 1, wherein:

the combining valve is configured to: (i) couple to respective injection-type extruders; and the conduit is configured to: (i) couple to the combining valve, and (ii) couple to the mold gate leading to the mold cavity defined by the mold.

14. The metal molding system of claim 1, wherein:

the combining valve has a non-flow state and a flow state, in the non-flow state, the combining valve is configured to: (i) not receive the alloys from respective injection-type extruders, and in the flow state, the combining valve is configured to: (i) receive the alloys from injection-type extruders respectively, the alloys combining, at least in part, to form the combined alloy in the combining valve; and the conduit is configured to: (i) receive the combined alloy from the combining valve, and (ii) communicate the combined alloy to the mold gate leading to the mold cavity defined by the mold.

15. The metal molding system of claim 1, wherein:

the combining valve is configured to couple to injection-type extruders;

the channel is configured to couple to the combining valve;

the shooting pot valve is configured to couple to the channel;

the shooting pot is configured to couple to the shooting pot valve; and the conduit is configured to couple to: (i) the shooting pot valve, and (ii) the mold gate leading to the mold cavity defined by the mold.

16. The metal molding system of claim 1, wherein:

the combining valve has a non-flow state and a flow state, in the non-flow state, the combining valve is configured to not receive the alloys from respective injection-type extruders, and in the flow state, the combining valve is configured to receive the alloys from the respective injection-type extruders, the alloys combining, at least in part, to form the combined alloy in the combining valve;

the channel is configured to receive the combined alloy from the combining valve;

the shooting pot valve has a first valve state and a second valve state, in the first valve state, the shooting pot valve is configured to not receive the combined alloy from the channel, and in the second valve state, the shooting pot valve is configured to receive the combined alloy from the channel;

the shooting pot is configured to receive the combined alloy from the shooting pot valve once the shooting pot valve is placed in the second valve state, and the shooting pot valve is configured to disconnect the channel from the shooting pot once the shooting pot valve is placed in the first valve state; and the conduit is configured to: (i) receive the combined alloy from the shooting pot valve once the shooting pot valve is placed in the first valve state, and (ii) communicate the combined alloy to the mold gate leading to the mold cavity defined by the mold.

17. The metal molding system of claim 1, wherein:

the combining valve is configured to: (i) couple to respective injection-type extruders, and (ii) couple to the shooting pot; and the conduit coupled to: (i) the combining valve, and (ii) the mold gate leading to the mold cavity defined by the mold.

18. The metal molding system of claim 1, wherein:

the combining valve has a first state and a second state, in the first state, the combining valve is configured to: (i) receive the alloys from respective injection-type extruders, the alloys combining, at least in part, to form the combined alloy in the combining valve, and (ii) transmit the combined alloy to the shooting pot, and in the second state, the combining valve is configured to: (i) not receive the alloys from the respective injection-type extruders, and (ii) permit the shooting pot to shoot the combined alloy back into the combining valve; and the conduit is configured to: (i) communicate the combined alloy, under pressure, from the combining valve to the mold gate once the combining valve is placed in the second state, the mold gate leading to the mold cavity defined by the mold.

19. The metal molding system of claim 1, wherein:

the combining valve is configured to: (i) couple to respective injection-type extruders, and (ii) couple to the mold gate leading to the mold cavity defined by the mold.

20. The metal molding system of claim 1, wherein:

the combining valve has a first state and a second state, in the first state, the combining valve is configured to: (i) receive the alloys from respective injection-type extruders, the alloys combining, at least in part, in the combining valve so as to form the combined alloy, and (ii) communicates the combined alloy to the mold gate leading to the mold cavity defined by the mold, and in the second state, the combining valve is configured to not receive the alloys from the respective injection-type extruders.

21. The metal molding system of claim 1, wherein the combining chamber is configured to communicate, under pressure, the combined alloy to the mold gate leading to the mold cavity defined by the mold, the combined alloy solidifying and forming a molded article in the mold cavity, the molded article being releasable from the mold after: (i) a clamping mechanism has ceased applying a clamp tonnage between a movable platen and a stationary platen, and (ii) the movable platen has been moved away from the stationary platen so as to separate a stationary mold portion from a movable mold portion, the stationary mold portion being supported by the stationary platen, and the movable mold portion being supported by the movable platen.

22. The metal molding system of claim 1, wherein the combining chamber includes:

a hot runner including:

a manifold having:

(i) switching valves coupled to respective injection-type extruders so as to receive the alloys from the respective injection-type extruders;

(ii) shooting pots coupled to the switching valves respectively; and (iii) the combining valve coupled to the shooting pots and also coupled to the mold gate leading to the mold cavity defined by the mold.

23. The metal molding system of claim 22, wherein the shooting pots each respectively includes:

pressure chambers being fillable with a pressurizable fluid;

accumulation chambers; and pistons that are each slidably movable between the pressure chambers respectively and the accumulation chambers respectively.

24. The metal molding system of claim 23, wherein once the combining valve and the switching valves are placed in a non-flow state, and the accumulation chambers are de-pressurized so as to permit the pistons to be movable, the respective injection-type extruders process and prepare the alloys.

25. The metal molding system of claim 23, wherein once the combining valve is placed in a non-flow state and the switching valves are placed in a flow state, and the respective injection-type extruders inject the alloys respectively into the accumulation chambers of the shooting pots respectively, and the pistons are moved into the pressure chambers respectively so as to displace the pressurizable fluid out from the pressure chambers.

26. The metal molding system of claim 23, wherein once the switching valves are placed in a non-flow state, the combining valve is placed in a flow state, and the pressure chambers are pressurized, then (i) the pistons are moved into the accumulation chambers respectively so as to inject or push the alloys respectively into the combining valve, and (ii) the alloys become combined, at least in part in the combining valve, to form the combined alloy, and the combined alloy then is pushed under pressure into the mold gate.

27. The metal molding system of claim 1, wherein the combining chamber includes:

a hot runner including:

a manifold having:

shooting pots coupled to respective injection-type extruders so as to receive the alloys from the respective injection-type extruders; and the combining valve coupled to the shooting pots and also coupled to the mold gate leading to the mold cavity defined by the mold.

28. The metal molding system of claim 27, wherein the shooting pots each respectively include:

pressure chambers being fillable with a pressurizable fluid;

accumulation chambers; and pistons that are slidably movable between the pressure chambers and the accumulation chambers.

29. The metal molding system of claim 28, wherein once the combining valve is placed in a non-flow state, the respective injection-type extruders accumulate and then inject the alloys respectively into the accumulation chambers.

30. The metal molding system of claim 28, wherein:

once the alloys are received into their respective accumulation chambers, screws of the respective injection-type extruders maintain their positions so as to prevent flow of the alloys back into the respective injection-type extruders, and once the combining valve is placed in a flow state, then the pressure chambers are pressurized so as to move the pistons into the accumulation chambers respectively so as to inject the alloys respectively from the accumulation chambers into the combining valve.

31. The metal molding system of claim 1, wherein the combining chamber includes:

a hot runner including:

a manifold having:

the combining valve coupled to injection-type extruders; and nozzles coupled to the combining valve, and also coupled to respective gates leading to mold cavities defined by a mold body of the mold, and in operation, the alloys combine to form the combined alloy at least in part in the combining valve and the nozzles.

* * * * *